US005515155A

United States Patent [19]

Folkins

[11] Patent Number: 5,515,155

[45] Date of Patent: May 7, 1996

[54] METHOD AND APPARATUS FOR ESTABLISHING EXPOSURE AND DEVELOPER SET POINTS FOR COLOR IMAGE FORMATION

[75] Inventor: Jeffrey J. Folkins, Rochester, N.Y.

[73] Assignee: Xerox Corporation, Stamford, Conn.

[21] Appl. No.: 483,613

[22] Filed: Jun. 7, 1995

[51] Int. Cl.[6] ..... G03G 15/01

[52] U.S. Cl. ..... 355/326 R; 355/327; 430/42

[58] Field of Search ..... 355/326 R, 327, 355/77; 430/42, 44; 347/232

[56] References Cited

U.S. PATENT DOCUMENTS

| | | | |
|---|---|---|---|
| 4,660,059 | 4/1987 | O'Brien | 346/157 |
| 4,833,503 | 5/1989 | Snelling | 355/259 |
| 5,155,541 | 10/1992 | Loce et al. | 355/326 X |
| 5,241,356 | 8/1993 | Bray et al. | 355/326 X |
| 5,241,358 | 8/1993 | Germain et al. | 355/326 |
| 5,241,359 | 8/1993 | Williams | 355/326 |
| 5,339,135 | 8/1994 | Scheuer et al. | 355/326 X |
| 5,347,345 | 9/1994 | Osterhoudt | 355/246 |
| 5,450,189 | 9/1995 | Russell | 355/326 |

FOREIGN PATENT DOCUMENTS 1-340663 12/1989 Japan .

*Primary Examiner*—R. L. Moses

*Attorney, Agent, or Firm*—Henry Fleischer; John E. Beck; Ronald Zibelli

[57] ABSTRACT

An apparatus for creating multiple color images is disclosed. The apparatus includes a charge retentive surface having a voltage saturation level, a plurality of imaging devices, and a plurality of developing devices. A first imaging device records a latent image on the charge retentive surface at a first exposure level. The latent image is then developed with a layer of toner particles by a first developing device. A second imaging device records a second latent image at a second exposure level. The second exposure level is a function of the voltage saturation level for the charge retentive surface and the maximum mass of the first layer of toner particles. A second developing device develops the second latent image with a second layer of toner particles and a third imaging device records a third latent image at a third exposure level. The third exposure level is a function of the voltage saturation level for the charge retentive surface, the maximum mass of the first layer of the toner particles, and the maximum mass of the second layer of the toner particles. A third developing device develops the third latent image with a third layer of toner particles.

33 Claims, 7 Drawing Sheets

METHOD AND APPARATUS FOR ESTABLISHING EXPOSURE AND DEVELOPER SET POINTS FOR COLOR IMAGE FORMATION

This invention relates generally to color imaging and more particularly to the use of plural exposure and development steps for such purposes.

One method of printing in different colors is to uniformly charge a charge retentive surface and then optically expose the surface to information to be reproduced in one color. This information is rendered visible using marking particles followed by the recharging of the charge retentive surface prior to a second exposure and development. This recharge/expose/and develop (READ) process may be repeated to subsequently develop images of different colors in superimposed registration on the surface before the full color image is subsequently transferred to a support substrate. The different colors may be developed on the photoreceptor in an image on image development process. The images may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

Several image quality issues arise that are unique to the REaD image on image process of creating multi-color images. The image quality issues that distinguish the REaD image process from a highlight color development process are called REaD interactions. These interactions include a residual toner voltage, an effective photoreceptor dielectric thickness change, and an exposure light loss. They are responsible for many image quality defects comprising color shifts, increased moire, increased color shift sensitivity to image misregistration and motion quality, toner spreading at image edges, and a loss in latitude for many of the photoreceptor subsystems.

The residual toner voltage is often the most severe of the REaD interactions. When a significantly thick layer of developed toner contains distributed charges and is insulative and non-photoconductive, a residual charge and resultant voltage drop ($V_t$) exists across the toner layer. In the REaD process, the developed and recharged toner layer exhibits a large residual toner voltage $V_t$. The $V_t$ prevents an effective voltage above any previously developed toned area from being re-exposed to light and discharged to the same level as a neighboring bare photoreceptor area. Instead, $V_t$ offsets the image development potential so as to shift the developability relationship and lower development.

The residual toner mass associated with a previously developed toner image increases the effective dielectric thickness and reduces effective development field in the toned area. It further hinders an attempt to achieve a desired uniform consistency of the developed mass of subsequent toner images. Consequently, another REaD interaction that must be addressed for image quality is the effective photoreceptor dielectric thickness change. The physical thickness of a previously developed toner image creates a the problem wherein, the effective thickness of the photoreceptor is significantly different for a toned area when compared to a neighboring bare area on the photoreceptor surface. This thickness differential causes a neutralized voltage to developed mass relationship to be different for toned and untoned areas. As a result, changes occur in the slope of the developability response.

Lastly, exposure light loss must be addressed for image quality. Light required to expose a REaD image travels through the toner of any previously developed area on the photoreceptor. As the light travels through the developed toner separations, it is scattered or absorbed. Hence, the photoreceptor exposure level for the previously developed area is lower than the photoreceptor exposure level required for untoned areas.

In response to these interactions, a need exists for establishing exposure and development set points in a REaD image on image system that allows for a maximum color range with improved image quality.

Various approaches have been devised for correcting one or more of the image quality defects in the image on image color formation process. The following disclosures may be relevant to various aspects of the present invention.

U.S. Pat. No. 4,833,503

Patentee: Snelling

Issued: May 23, 1989

U.S. Pat. No. 4,660,059

Patentee: O'Brien

Issued: Apr. 21, 1987

Japanese Patent No. Hei 1-340663

Assignee: Matsushita Denki Sangyo K.K.

Published: Sep. 4, 1991

U.S. patent application Ser. No. 08/347,616

Applicant: Pietrowski et al.

Filed: Nov. 30, 1994

U.S. patent application Ser. No. 08/347,617

Applicant: Folkins et al.

Filed: Nov. 30, 1994

The disclosures of the above-identified patents may be briefly summarized as follows:

U.S. Pat. No. 4,833,503 describes a multi-color printer wherein a recharging step is employed following the development of a first image. This recharging step, according to the patent is used to enhance uniformity of the photoreceptor potential, i.e. neutralize the potential of the previous image.

U.S. Pat. No. 4,660,059 describes an ionographic printer. A first ion imaging device forms a first image on the charge retentive surface which is developed using toner particles. The charge pattern forming the developed image is neutralized prior to the formation of a second ion image by a corona generating unit and an erase lamp.

Japanese Patent No. Hei 1-340663 describes a color image forming apparatus wherein a first and second charging device are used to recharge a photoconductor carrying a first developed image, before exposure and development of a subsequent image thereon. The potential of the photoconductor is higher after passing the first charging device than after passing the second charging device. The difference in voltage applied by the first and second charging devices to the toner image and photoreceptor surface is set to a relatively high level, to insure that the polarity of the toner image is reversed after passing and having been charged by both devices. The effect reduces the residual charge in the image areas which becomes more severe when applying color toners onto previously developed color toners, and also to prevent toner spread during the exposure process. In areas where the edges of a prior developed image align but do not overlap with the edges of a subsequent image, the toner of the prior image tends to spread along its edges into the subsequently exposed areas which have a relatively lower charge level. By reversing the polarity of the toner as taught in this reference, toner spread is prevented, as the reversed polarity toner is no longer attracted to the exposed areas.

U.S. patent application Ser. No. 08/347,616 describes a voltage sensitive recharge device for reducing residual toner voltage. The recharge device is used for the recharging steps during a color image formation. The graph of the output current (I) to the charge retentive surface, as a function of the voltage to the charge retentive surface (V), has a high (I/V) slope. The high I/V slope recharge device employs an AC voltage supplied thereto, which enables an extended time for neutralization to occur at the top of the toner layers.

U.S. patent application Ser. No. 08/347,617 describes a recharge step between two image creation steps for recharging a charge retentive surface to a predetermined potential pursuant to forming the second of the two images. A first corona generating device recharges the charge retentive surface to a higher absolute potential than a predetermined potential, and then a second corona generating device recharges the charge retentive surface to the predetermined potential. An electrical charge associated with the first image is substantially neutralized after being recharged by the first and second corona generating device.

In accordance with one aspect of the invention, an apparatus for creating multiple color images is provided and includes a charge retentive surface having a voltage saturation level. An imaging device records a first latent image on the charge retentive surface. A first developing device develops the first latent image with a first layer of non-black toner particles. The imaging device then records a second latent image at a second exposure level. The second exposure level is a function of the voltage saturation level for the charge retentive surface and the maximum mass of the first layer of non-black toner particles.

In accordance with another aspect of the invention, an apparatus for creating multiple color images is provided and includes a charge retentive surface having an exposure response relationship according to $Exp_{pr}(10\%)/Exp_{pr}(50\%)<2.2$. $Exp_{pr}(10\%)$ represents a first exposure value to which the charge retentive surface is discharged to a percentage difference between the dark decay voltage of the charge retentive surface and the saturation voltage for the charge retentive surface. $Exp_{pr}(50\%)$ represents a second exposure value to which the charge retentive surface is discharged to a percentage difference between the dark decay voltage of the charge retentive surface and the saturation voltage for the charge retentive surface.

In accordance with yet another aspect of the invention, a printing machine for creating multiple color images is provided and includes a charge retentive surface having a voltage saturation level. An imaging device records a first latent image on the charge retentive surface. A first developing device develops the first latent image with a first layer of non-black toner particles. The imaging device then records a second latent image at a second exposure level. The second exposure level is a function of the voltage saturation level for the charge retentive surface and the maximum mass of the first layer of non-black toner particles.

In accordance with still another aspect of the invention, a printing machine for creating multiple color images is provided and includes a charge retentive surface having an exposure response relationship according to $Exp_{pr}(10\%)/Exp_{pr}(50\%)<2.2$. $Exp_{pr}(10\%)$ represents a first exposure value to which the charge retentive surface is discharged to a percentage difference between the dark decay voltage of the charge retentive surface and the saturation voltage for the charge retentive surface. $Exp_{pr}(50\%)$ represents a second exposure value to which the charge retentive surface is discharged to a percentage difference between the dark decay voltage of the charge retentive surface and the saturation voltage for the charge retentive surface.

In accordance with yet another aspect of the invention, there is provided a method of creating multiple color images. The method includes recording a first latent image on a charge retentive surface having a voltage a voltage saturation level, developing the first latent image with a first layer of non-black toner particles, and recording a second latent image at a second exposure level. The second exposure level is a function of the voltage saturation level for the charge retentive surface and the maximum mass of the first layer of non-black toner particles.

In accordance with yet still another aspect of the invention, there is provided a method of setup for a multicolor printing. The method includes: depositing a first non-black toner layer on a surface, depositing a second non-black toner layer on the first non-black toner layer, and increasing the second non-black toner layer mass to form a composite color having a saturated hue.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims, including a multiple pass image on image color process system, and a single or multiple pass highlight color system.

Figure 1:
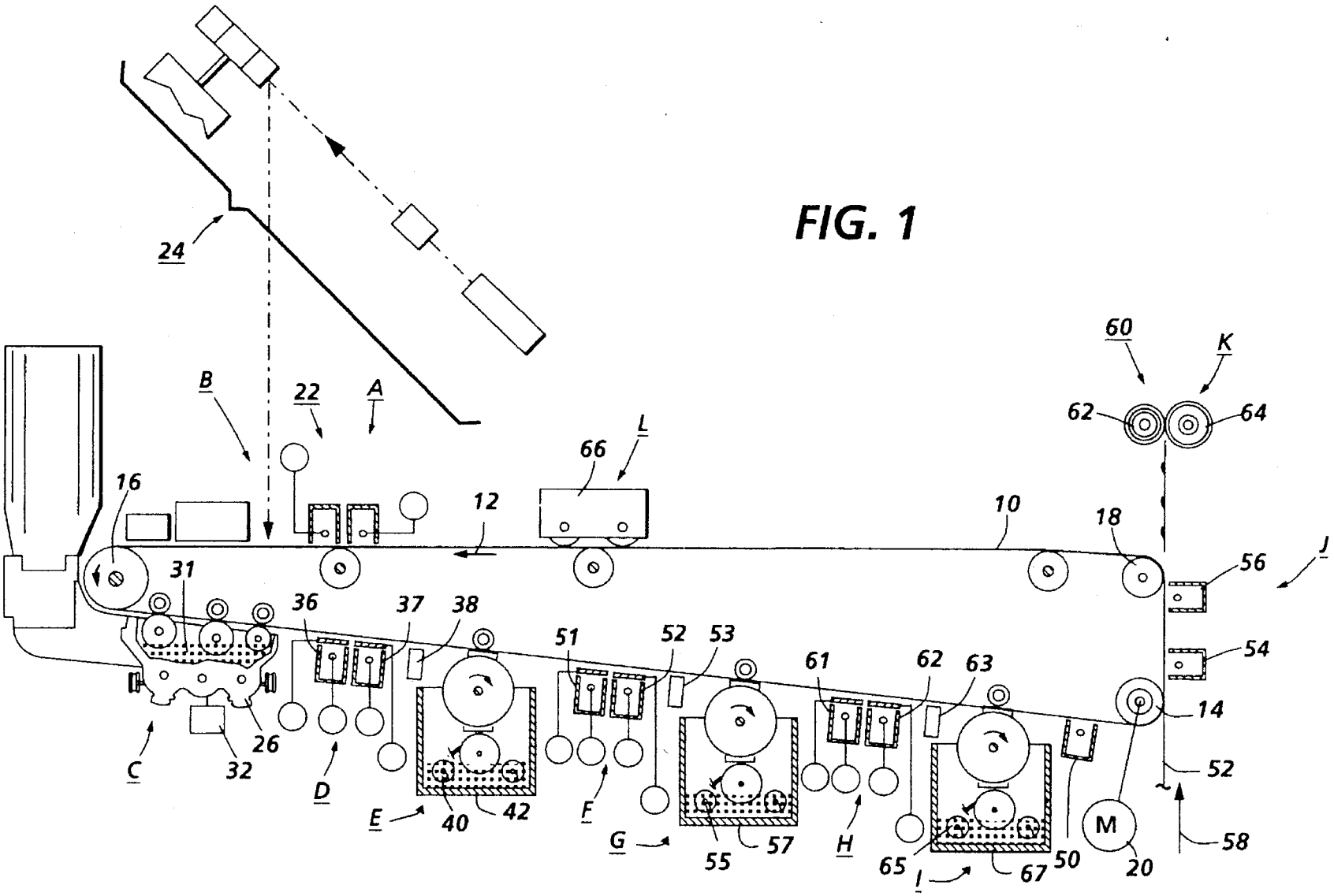
FIG. 1 is an elevational view of a printing machine in which the present invention can be utilized.

For a general understanding of the features of the present invention, reference is made to the drawings. In the drawings, like reference numerals have been used throughout to designate identical elements. FIG. 1, schematically depicts the various elements of an illustrative electrophotographic printing machine incorporating established set points for exposure and development which are used to produce an image on image color output in a single revolution or pass of a photoreceptor belt. It will become evident from the following discussion that the established exposure and developer set points are equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of photoconductive surface is advanced through an imaging station B. At imaging station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices known in the art.

The photoreceptor, which is initially charged to a voltage $V_0$, undergoes dark decay to a dark decay potential ($V_{ddp}$) equal to approximately −500 volts. When exposed at the exposure station B the image areas are discharged to a discharged area development voltage ($V_{DAD}$) equal to about −50 volts. Thus after exposure, the photoreceptor contains a monopolar voltage profile of high and low voltages, the former corresponding to charged areas and the latter corresponding to discharged or image areas.

At a first development station C, a magnetic brush developer structure, indicated generally by the reference numeral 26 advances insulative magnetic brush (IMB) material 31 into contact with the electrostatic latent image. The development structure 26 comprises a plurality of magnetic brush roller members. These magnetic brush rollers present, for example, negatively charged black toner material to the image areas for development thereof. Appropriate developer biasing is accomplished via power supply 32. Electrical biasing is such as to effect discharged area development (DAD) of the lower (less negative) of the two voltage levels on the photoreceptor with the material 31.

At recharging station D, a pair of corona recharge devices 36 and 7 are employed for adjusting the voltage level of both the toned and untoned areas on the photoreceptor surface to a substantially uniform level. A power supply coupled to each of the electrodes of corona recharge devices 36 and 37 and to any grid or other voltage control surface associated therewith, serves as a voltage source to the devices. The recharging devices 36 and 37 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 36 overcharges the photoreceptor surface 10 containing previously toned and untoned areas, to a level higher than the voltage level ultimately required for $V_{ddp}$, for example to −700 volts. The predominant corona charge delivered from corona recharge device 36 is negative. The second corona recharge device 37 reduces the photoreceptor surface 10 voltage to the desired $V_{ddp}$, −500 volts. Hence, the predominant corona charge delivered from the second corona recharge device 37 is positive and a voltage split ($V_{split}$) of 200 volts is applied to the photoreceptor surface. The surface 10 potential after having passed each of the two corona recharge devices, as well as the amount of voltage split of the photoreceptor, are preselected to otherwise prevent the electrical charge associated with the developed image from substantially reversing in polarity, so that the occurrence of under color splatter (UCS) is avoided. Further, the corona recharge device types and the voltage split are selected to ensure that the charge at the top of the toner layer is substantially neutralized rather than driven to the reverse polarity (e.g. from negative to become substantially positive).

A second exposure or imaging device 38 which may comprise a laser based output structure is utilized for selectively discharging the photoreceptor on toned areas and/or bare areas to approximately −50 volts, pursuant to the image to be developed with the second color developer. The photoreceptor now contains toned and untoned areas at relatively high voltage levels (−500 volts) and toned and untoned areas at relatively low voltage levels (−50 volts). These low voltage areas represent image areas which are to be developed using discharged area development. A negatively charged developer material 40 comprising, for example, yellow color toner is employed. The toner is contained in a developer housing structure 42 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 40.

At a second recharging station F, a pair of corona recharge devices 51 and 52 are employed for adjusting the voltage level of both the toned and untoned areas on the photoreceptor to a substantially uniform level. A power supply coupled to each of the electrodes of corona recharge devices 51 and 52 and to any grid or other voltage control surface associated therewith, serves as a voltage source to the devices. The recharging devices 51 and 52 serve to substantially eliminate any voltage difference between toned areas and bare untoned areas, as well as to reduce the level of residual charge remaining on the previously toned areas so that subsequent development of different color toner images is effected across a uniform development field. The first corona recharge device 51 overcharges the photoreceptor surface containing previously toned and untoned areas, to a level higher than the voltage level ultimately required for $V_{ddp}$, for example to −700 volts. The predominant corona charge delivered from corona recharge device 51 is negative. The second corona recharge device 52 reduces the photoreceptor voltage to the desired $V_{ddp}$, −500 volts. Hence, the predominant corona charge delivered from the second corona recharge device 52 is positive. The surface potential after having passed each of the two corona recharge devices, as well as the amount of voltage split, are preselected to otherwise prevent the electrical charge associated with the developed image from substantially reversing in polarity, so that the occurrence of UCS is avoided. Further, the corona recharge device types and the voltage split are selected to ensure that the charge at the top of the toner layer is substantially neutralized rather than driven to the reverse polarity.

A third latent image is created using an imaging or exposure member 53. In this instance, a third DAD image is formed, discharging to approximately −50 volts those bare areas and toned areas of the photoreceptor that will be developed with the third color image. This image is developed using a third color toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 62 are employed for adjusting the voltage level of both the toned and untoned areas on the photoreceptor to a substantially uniform level. A power supply coupled to each of the electrodes of corona recharge devices 61 and 62 and to any grid or other voltage control surface associated therewith, serves as a voltage source to the devices. The recharging devices 61 and 62 serve to substantially eliminate any voltage difference between toned areas and bare untoned areas as well as to reduce the level of residual charge remaining on the previously toned areas, so that subsequent development of different color toner images is effected across a uniform development field. The first corona recharge device 61 overcharges the photoreceptor surface containing previously toned and untoned areas, to a level higher than the voltage level ultimately required for $V_{ddp}$, for example to −700 volts. The predominant corona charge delivered from corona recharge device 61 is negative. The second corona recharge device 62 reduces the photoreceptor voltage to the desired $V_{ddp}$, −500 volts. Hence, the predominant corona charge delivered from the second corona recharge device 62 is positive. The surface potential after having passed each of the two corona recharge devices, as well as the amount of voltage split, are preselected to otherwise prevent the electrical charge associated with the developed image from substantially reversing in polarity, so that the occurrence of UCS is avoided. Further, the corona recharge device types and the voltage split are selected to ensure that the charge at the top of the toner layer is substantially neutralized rather than driven to the reverse polarity.

A fourth latent image is created using an imaging or exposure member 63. A fourth DAD image is formed on both bare areas and previously toned areas of the photoreceptor that are to be developed with the fourth color image. This image is developed, for example, using a cyan color toner 66 contained in developer housing 67 at a fourth developer station I. Suitable electrical biasing of the housing 67 is provided by a power supply, not shown. In a single pass system as shown in FIG. 1, an advantage of developing the color toners in the order hereinbefore described, with black first, is the elimination of the need for one of the two corona recharge devices during the first recharge step, since subsequent color images are typically not developed over the image areas developed with black color toner.

The developer housing structures 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system.

In order to condition the toner for effective transfer to a substrate, a negative pre-transfer corotron member 50 delivers negative corona to ensure that all toner particles are of the required negative polarity to ensure proper subsequent transfer.

Subsequent to image development a sheet of support material 52 is moved into contact with the toner images at transfer station J. The sheet of support material is advanced to transfer station J by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer corona device 54 which sprays positive ions onto the backside of sheet 52. This attracts the negatively charged toner powder images from the belt 10 to sheet 52. A detack corona device 56 is provided for facilitating stripping of the sheets from the belt 10.

After transfer, the sheet continues to move, in the direction of arrow 58, onto a conveyor (not shown) which advances the sheet to fusing station K. Fusing station K includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L using a cleaning brush structure contained in a housing 66.

The various machine functions described hereinabove are generally managed and regulated by a controller (not shown), preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The recharge devices 36, 37, 51, 52, 61 and 62 have been described generally as corona generating devices, with reference to FIG. 1. However, it is understood that the corona generating devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

Attainment of high quality REaD image on image printing may be achieved by first configuring the system to reduce the the REaD interactions effects. Process set points comprising Exposure, $V_{ddp}$, $V_{exposure}$, and $V_{bias}$ are optimized so that there is minimal change with the REaD interactions. Once this is done any remaining levels of REaD interactions can be eliminated by instituting an image on image centered setup procedure in combination with pulse width modulation/halftoning techniques.

Figure 2:
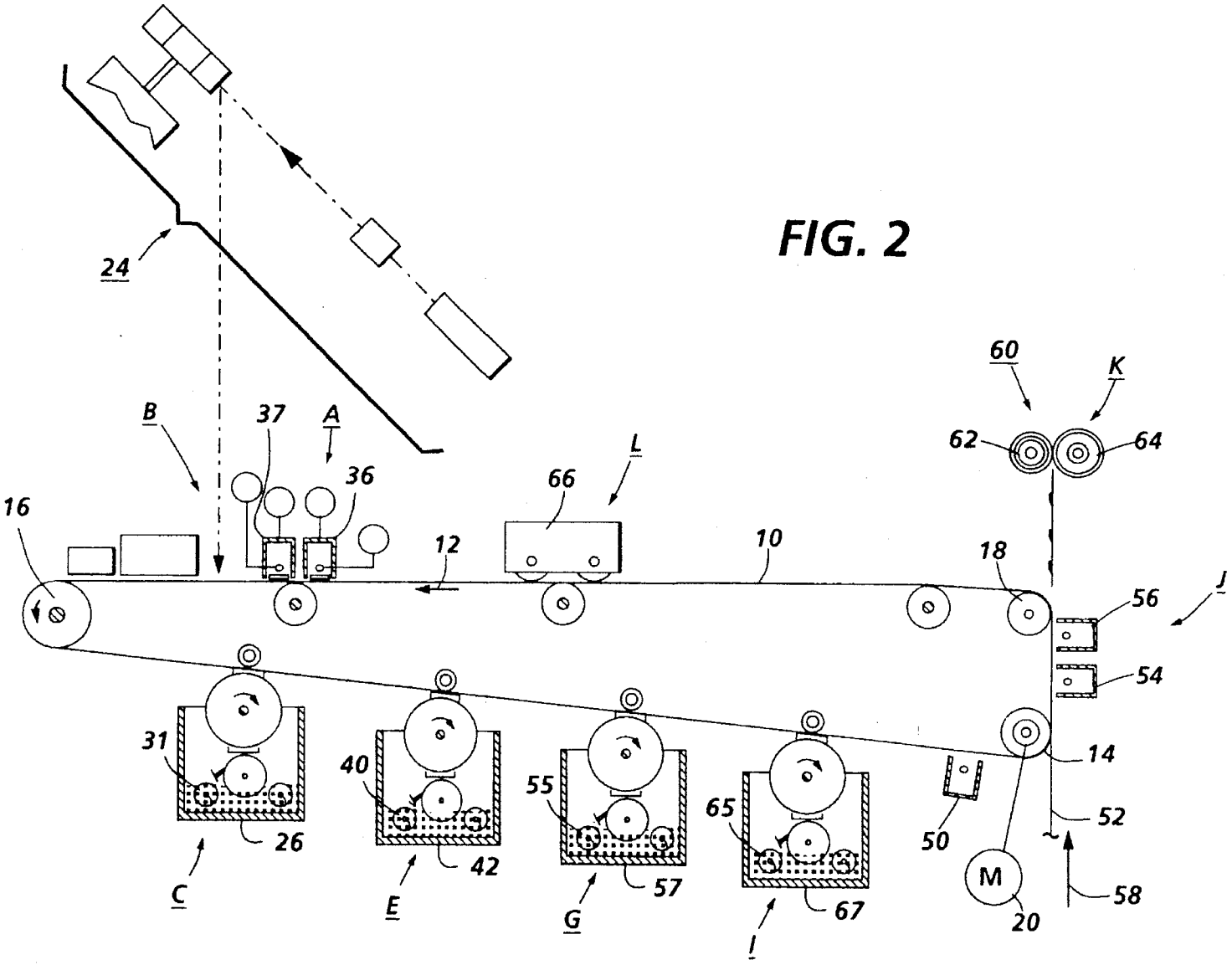
FIG. 2 is an elevational view of another printing machine in which the present invention can be utilized.

FIG. 2 illustrates another example of an electrostatographic printing apparatus incorporating established set points for exposure and development which are used to produce an image on image color output. FIG. 2 represents a multiple pass color image formation process, where each successive color image is applied in a subsequent pass or rotation of the photoreceptor. Like reference numerals to those in FIG. 1 correspond with identical elements to those represented in FIG. 2, with the exception that a non-interactive development system at Development Station C replaces the magnetic brush development system used as an example in FIG. 1, for purposes of illustration of alternate and equivalent embodiments for use with the present invention. Furthermore, in a multipass system as represented in FIG. 2, only a single set of recharging devices 36 and 37, indicated generally at charging/recharging station A, is needed to recharge the photoreceptor surface 10 prior to each subsequent color image formation. For purposes of simplicity, both recharging devices 36 and 37 can be employed for charging the photoreceptor using the split recharge concept of the present invention as hereinbefore described, prior to the exposure of each color toner latent image. However, it is understood that a controller (not shown) could be used to regulate the charging step so that only a single recharge device is used to charge the photoreceptor surface to the desired voltage level for exposure and development thereon. Also, only a single exposure device 24 is needed to expose the photoreceptor prior to each color image development. In a multipass system as illustrated in FIG. 2, it is understood that the cleaning station L is of the type that is capable of camming away from the surface of the photoreceptor during the image formation process, so that the image is not disturbed prior to image transfer.

In imaging, a significant reduction in the effect of the exposure light loss can be addressed through the use of high exposure levels. These exposure levels allow development voltages to extend beyond the knee of a photoreceptor discharge curve.

Figure 3:
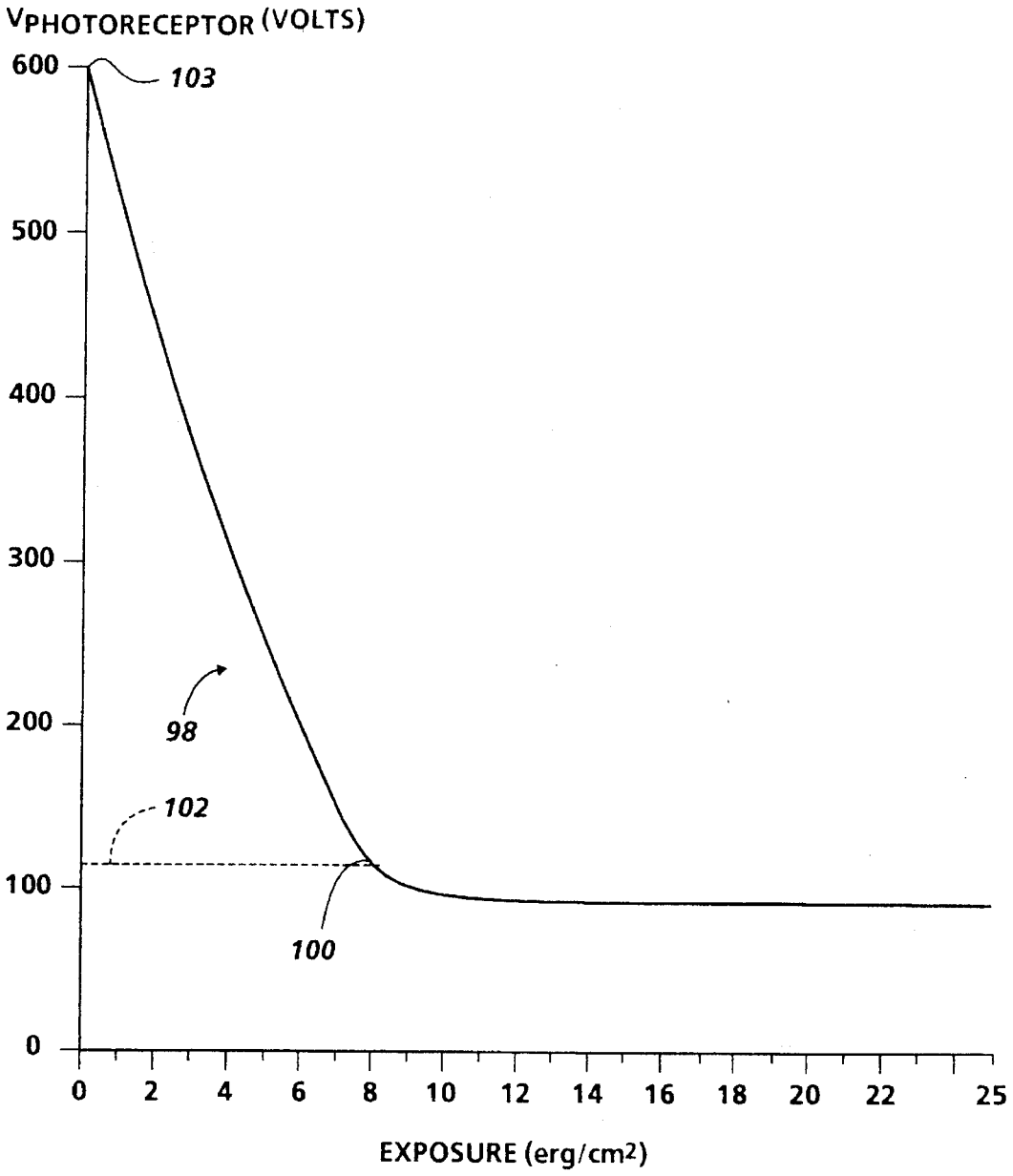
FIG. 3 is a schematic representation of a discharge curve for a photoreceptor used in the present invention.

Referring to FIG. 3, FIG. 3 is a schematic representation of a discharge curve for a photoreceptor used in the present invention. The photoreceptor discharge curve 98 saturates quickly to provide a well defined saturation value (Vsat) 102 at knee 100 regardless of the it's slope. Knee 100 of photoreceptor discharge curve 98 is the exposure level to which the photoreceptor has been exposed to more than 95 percent of the voltage of the maximum exposure level, i.e. 95 percent of the difference between the starting Vddp level 103 and the voltage of the maximum exposure level.

Using a quickly saturating photoreceptor in a REaD printing system reduces line broadening, blooming and halftone hole fill-in, all of which are serious print quality defects. A specification characterizing the exposure response relationship of a suitable photoreceptor is given by the following relationship:

$$Exp_{pr}(10\%)/Exp_{pr}(50\%)<2.2$$

where:

$Exp_{pr}(10\%)$ represents a first exposure value to which the photoreceptor is discharged to a percentage difference between the dark decay voltage (Vddp) of the photoreceptor and the saturation voltage (Vsat) for the photoreceptor;

$Exp_{pr}(50\%)$ represents a second exposure value to which the photoreceptor is discharged to a percentage difference between the dark decay voltage (Vddp) of the photoreceptor and the saturation voltage (Vsat) for the photoreceptor; and 2.2 represents the maximum value of the exposure ratio. The value of 2.2 provides a measure of the linearity of the photoreceptor discharge curve and hence, the quickness of the photoreceptor discharge saturation.

Figure 4:
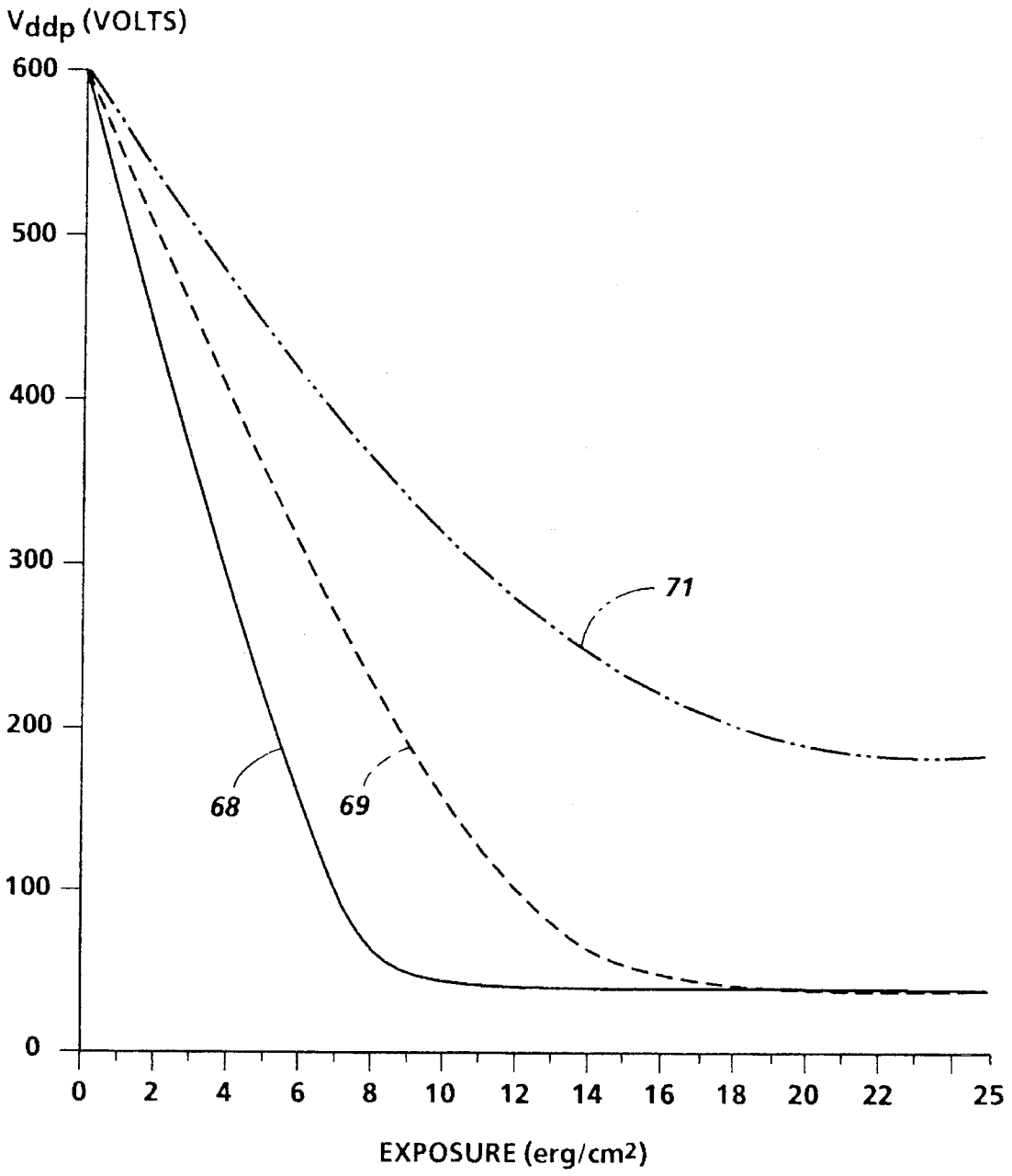
FIG. 4 is a schematic representation of photoreceptor discharge curves with and without toner thereon.

Exposure of multiple colors can be set up so that the photoreceptor discharges to a relatively flat knee while light is passing through the full mass of any prior layers of color toner. Although the voltage of an exposed bare photoreceptor will be greater than that of a photoreceptor exposed through layers of toner, the photoreceptor discharge is flat and the resultant photoreceptor image voltage will be fairly constant. FIG. 4 schematically shows the effect.

FIG. 4 is a schematic representation of a family of photoreceptor discharge curves with and without toner thereon. Discharge curve 68 illustrates the response of a bare photoreceptor response without toner deposited thereon. Discharge curve 69 illustrates the effective response of an imager light beam traveling through a toner layer sufficient to cause a 40 percent light reduction (60 percent transmission). Finally, discharge curve 71 shows an effective response with toner having a 40 percent light loss and a toner residual voltage $V_t$ of approximately 150 volts. Edge diffraction and scattering effects have been observed to be minimal and there is little measured line broadening when the exposure light passes through toner layers representative of the discharge curves 69 and 70 shown in FIG. 4.

Consequently, photoreceptor exposure levels are set to reduce image quality defects caused by the REaD interactions. Enhanced moire, increased sensitivity to motion quality banding, and poor overlay dot quality, for example, are reduced by a color-by-color exposure setup procedure.

In the color-by-color exposure setup procedure, an exposure level for a first non-black color may be set to any value sufficient to provide adequate development of that color. An exposure level for a second nonblack color is then set to a value being greater than or equal to the saturation knee for the photoreceptor discharge curve divided by the light fraction transmitted through the maximum mass of the first non-black toner layer. Finally, an exposure level for a third non-black color is set to a value being greater than or equal to the saturation knee for the photoreceptor discharge curve divided by the light fraction transmitted through the maximum mass of both the first and second non-black toner layers.

Exposure levels for the first, second, and third color refer to primary colors, wherein black does not constitute a color because it neither reflects or transmits light. For example, if the actual development order of the electrophotographic printing machine in FIG. 1 were yellow, black, magenta, and cyan, then the color-by-color exposure setup only applies to REaD process steps 1,3, and 4.

The color sequence ordering of the color-by-color exposure setup procedure should be in the order of light absorption at the imager wavelength. For example, the least absorbing toner being sequenced first and followed by the second least light absorbing toner. The sequencing of black may be anywhere. If two different toners have substantially the same absorption, then the sequence ordering does not matter.

Imaging in a REaD printing system is accomplished by pulse width modulation instead of amplitude modulation. With pulse width modulation, image pixels are exposed and developed to a single saturated level while gray scale information is obtained by varying the width of a pixel as opposed to its level. Accordingly with pulse width modulation, the imager beam profile must be narrower and possesses sharper edges when compared to a pixel width.

Both the maximum slow scan beam spot size and the maximum fast scan (perpendicular direction) beam control REaD interaction effects to improve printed edge resolution and print quality stability. These two maximum beam spot sizes are made smaller than the pixel size. Hence, the maximum slow scan exposure beam spot profile is given by the formula:

$$E(X_{ss}/2)/E(0)<0.5$$

where again:

$x_{ss}$ represents the spacing between scan lines (e.g. 1/600 inches).

$E(x_{ss})$ represents the imager spot exposure as a function of distance from the center of the spot in the slow scan direction; and E(0) represents the imager spot exposure at zero distance from the center of the scanlines.

Similarly, the maximum fast scan exposure beam spot profile is given by the formula:

$$E(x_{fs}/2)/E(0)<0.5$$

where:

$x_{fs}$ represents the spacing between scan lines (e.g. 1/600 inches).

$E(x_{fs})$ represents the imager spot exposure as a function of distance from the center of the spot in the fast scan direction; and E(0) represents the imager spot exposure at zero distance from the center of the scanlines.

The minimum slow scan (process direction) beam profile reduces maximum exposure requirements so as to lower line growth, blooming, and halftone fill-in. It also reduces the banding/color shift effects resulting from misregistration. Thus, the minimum slow scan exposure beam spot profile is given by the following formula:

$$E(X_{ss}/2)/E(0)>0.35$$

where:

$x_{ss}$ represents the spacing between scan lines (e.g. 1/600 inches).

$E(x_{ss})$ represents the imager spot exposure as a function of distance from the center of the spot in the slow scan direction; and E(0) represents the imager spot exposure at zero distance from the center of the scanlines.

Turning now to the developability of saturated toners, the CIE L*a*b* measurements for chroma, hue, and L* are less sensitive to mass variations than previously thought.

Figure 5:
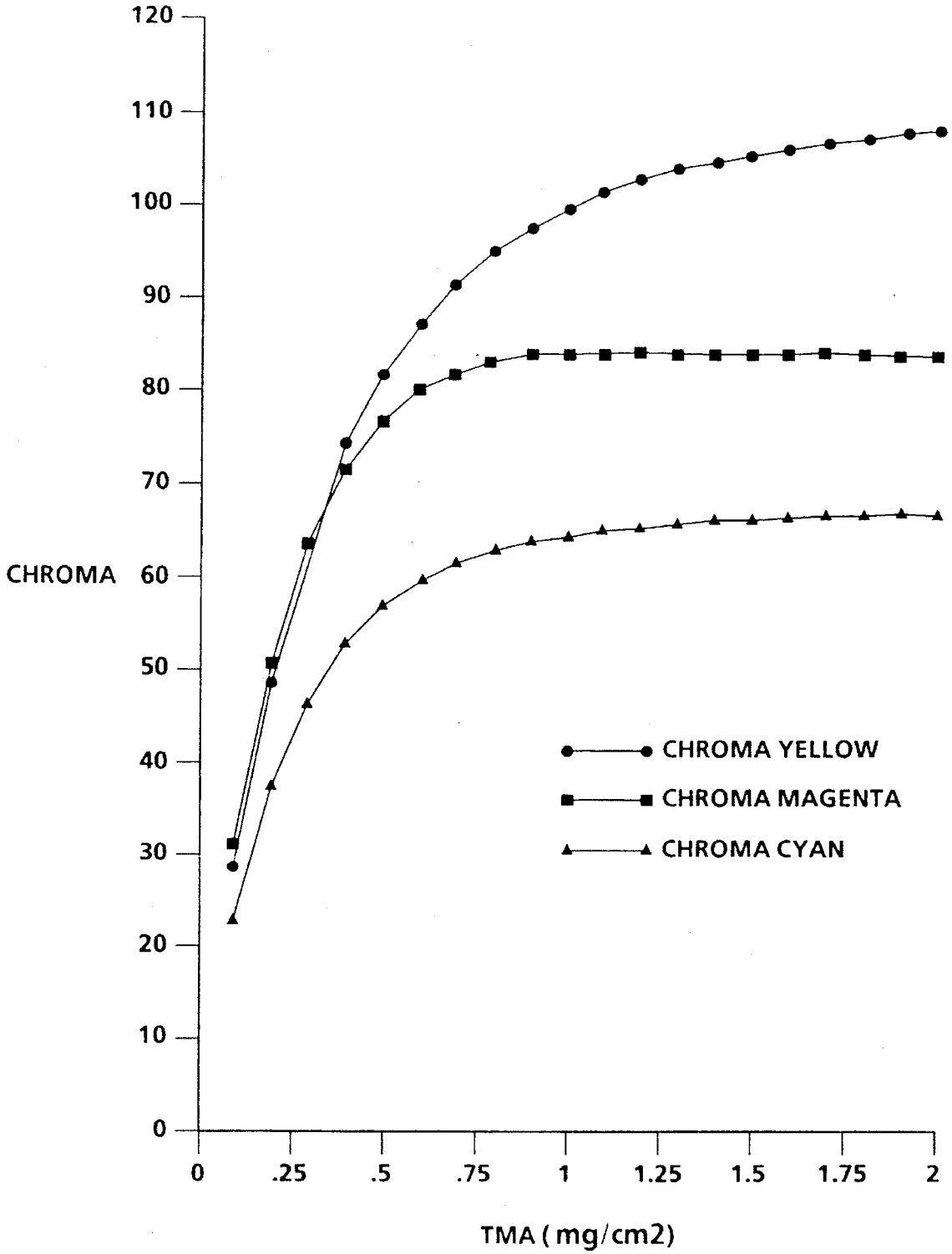
FIG. 5 is a schematic representation of chroma versus toner mass area (TMA) curves for xerographic color toners.

Referring to chroma, FIG. 5 is a schematic representation of chroma versus transferred mass/area (TMA) curves for xerographic color toners. The curve for each toner shows that the chroma is a slowly varying function of TMA past saturation and approximately 1 mg/cm$^2$ for 11 micron size toners.

Figure 6:
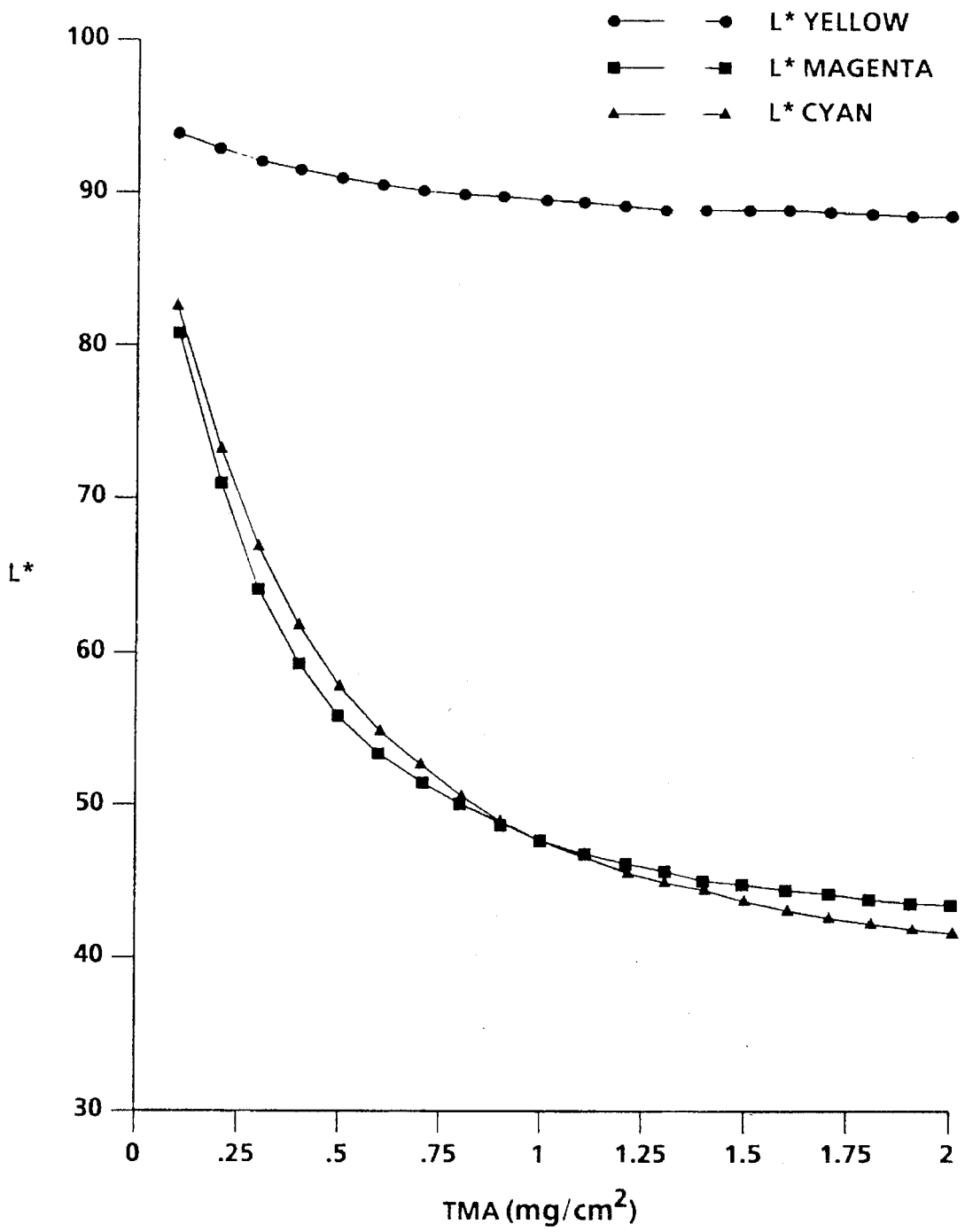
FIG. 6 is a schematic representation of L* versus toner mass area (TMA) curves for xerographic color toners.

L* represents a differential response of the human eye to a developed image that is used as a metric for density variation. Referring to FIG. 6, FIG. 6 is a schematic representation of L* versus TMA curves for xerographic color toners. These curves indicates that L* is also a slowly varying function of saturation above about 1 mg/cm2.

In FIGS. 5 and 6 it can be observed that the developed mass for a given toner will either be a nominal value, as determined by set electrostatics on a bare photoreceptor, or a lower value of developed mass (due to REaD interactions) when developing on top of another toner layer. The uncontrollable difference in masses when developing toner on top of another toner layer causes the REaD image on image print quality defects.

A development set-up procedure to maximize insensitivity to the REaD interactions may be derived from the foregoing observations wherein, the colorimetry saturates above a certain toner mass, and the toner mass varies between two reasonably well defined values. The development procedure comprises setting the developed mass for a low mass worst case of toner on toner equal to the approximate mass value of the saturation point on the respective chroma versus TMA curve (approximately 0.75 mg/cm$^2$ in FIG. 5). This development procedure insures that the toner mass, for all cases of either a prior layer or not, will fall on the saturated chroma portion of the chroma versus TMA curve.

The development procedure may be implemented in a REaD printing system by firstly setting a desired single mass development for a first color such as, for example, yellow. Secondly, developing a second color such as, for example, magenta on top of a full layer of the first color to make a composite color of red. Thirdly, increasing the second color developability until the colorimetry such as the hue of the color saturates.

Subsequent developabilities are set up in a similar manner. The full mass of the first and second colors are developed (the second color being determined being determined by the preceding development procedure). Lastly, the developability of the third color is varied until the hue or colorimetry saturates.

The development of black toner is an exception to the foregoing development procedure. If black toner is developed first, then the steps for developing colors apply to the first, second, and third color developed after black and not black itself.

Figure 7:
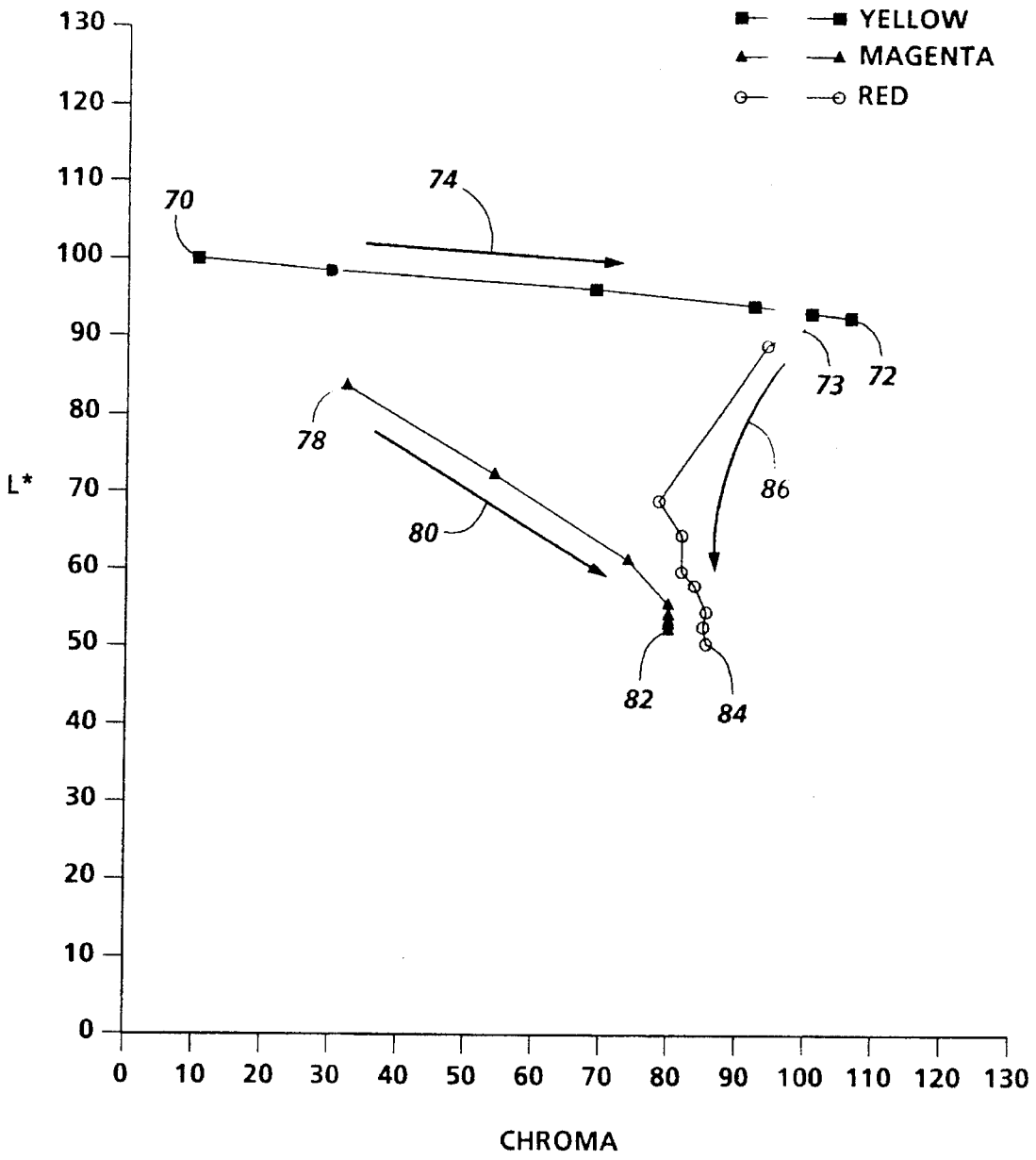
FIG. 7 is a set of developability curves of L* versus Chroma for a color red.

FIG. 7 is a set of developability curves of L* versus Chroma for a color red. Referring to FIG. 7, a first color mass of yellow toner is set at point 70. Yellow development is increased in equal steps in the direction of arrow 74 until a final yellow toner mass is fixed at point 72. Next, a second color mass of magenta toner is set at point 78. Magenta toner is developed over the yellow toner to form a composite color red that starting at point 73. The mass of the magenta toner is increased in equal steps along the direction of arrow 80 to achieve a desired red hue in the direction of arrow 86 at point 84. It can be seen, in FIG. 7, that even though the the final magenta mass exceeds that which is necessary to achieve a reasonable magenta L*/chroma, the extra magenta mass has no adverse effects on the magenta L*/chroma.

While the foregoing description has been directed to a $DAD^n$ image on image process color printer where a full color image is built in a single pass of the charge photoreceptor, it will be appreciated that the invention may also be used in a charged area development $CAD^n$ or $CADDAD^n$ in both single pass or multiple pass systems, as well as in a single or multiple pass highlight color process machine.

I claim:

1. An apparatus for creating multiple color images, including:

a charge retentive surface having a voltage saturation level;

an imaging device which records a first latent image on said charge retentive surface; and a first developing device which develops the first latent image with a first layer of non-black toner particles, said imaging device recording a second latent image at a second exposure level with the second exposure level being a function of the voltage saturation level for said charge retentive surface and the first layer of non-black toner particles maximum mass.

2. An apparatus according to claim 1, wherein said imaging device includes:

a first imaging device to record the first latent image; and a second imaging device to record the second latent image.

3. An apparatus according to claim 1, further including a second developing device which develops the second latent image with a second layer of non-black toner particles, said imaging device records a third latent image at a third exposure level with the third exposure level being a function of the voltage saturation level for said charge retentive surface, the first layer of the non-black toner particles maximum mass and the second layer of the non-black toner particles maximum mass.

4. An apparatus according to claim 3, further including a third developing device which develops the third latent image with a third payer of non-black toner particles.

5. An apparatus according to claim 1, wherein the voltage saturation level for said charge retentive surface is defined as an exposure level at which a voltage on said charge retentive surface is discharged by light exposure to 95 percent of the level for said charge retentive surface.

6. An apparatus according to claim 1, wherein the function for setting the second exposure value is defined as an exposure level greater than or equal to the voltage saturation level for said charge retentive surface divided by a fraction of light transmitted through the first nonblack toner layer maximum mass.

7. An apparatus according to claim 6, wherein the function for setting the third exposure value is defined as an exposure level greater than or equal to the saturation level for said charge retentive surface divided by a fraction of light transmitted through the first non-black toner layer maximum mass and the second non-black toner layer maximum mass.

8. An apparatus for creating multiple color images including a charge retentive surface having an exposure response relationship according to:

$$Exp_{pr}(10\%)/Exp_{pr}(50\%)>2.2$$

where:

$Exp_{pr}(10\%)$ represents a first exposure value to which said charge retentive surface is discharged to a percentage difference between the dark decay voltage of said charge retentive surface and the saturation voltage for said charge retentive surface;

$Exp_{pr}(50\%)$ represents a second exposure value to which said charge retentive surface is discharged to a percentage difference between the dark decay voltage of said charge retentive surface and the saturation voltage for said charge retentive surface.

9. An apparatus according to claim 1, further comprising means for pulse width modulating said imaging device.

10. An apparatus wherein said charge retentive surface moves in a process direction according to claim 1, wherein said imaging device forms a spot in a process direction having a minimum size according to:

$$E(X_{ss}/2)/E(0)>0.35$$

where:

$x_{ss}$ represents a spacing between scan lines;

$E(x_{ss})$ represents the imaging device exposure as a function of distance from the center of the spot for a single spot in a slow scan direction; and E(0) represents the imaging device exposure at zero distance from the center of the scan lines.

11. An apparatus according to claim 10, wherein said imaging device forms a spot in a process direction having a maximum size according to $E(x_{ss}/2)/E(0)<0.5$.

12. An apparatus according to claim 10, wherein said imaging device forms a spot in a direction substantially perpendicular to the process direction having a maximum size according to $E(x_{fs}/2)/E(0)<0.5$ where $E(x_{fs})$ represents the imaging device exposure as a function of distance from the center of the spot for a single spot in a fast scan direction.

13. An apparatus according to claim 1, wherein:

said first developing device develops the first latent image with toner particles of a first color; and said second developing device develops the second latent image with toner particles of a second color with the first color being different from the second color.

14. An apparatus according to claim 13, wherein the first toner particles absorb less light than the second toner particles.

15. A printing machine for creating multiple color images including:

a charge retentive surface having a voltage saturation level;

an imaging device which records a first latent image on said charge retentive surface; and a first developing device which develops the first latent image with a first layer of non-black toner particles, said imaging device recording a second latent image at a second exposure level with the second exposure level being a function of the voltage saturation level for said charge retentive surface and the first layer of non-black toner particles maximum mass.

16. A printing machine according to claim 15, wherein said imaging device includes:

a first imaging device to record the first latent image; and a second imaging device to record the second latent image.

17. A printing machine according to claim 15, further including a second developing device which develops the second latent image with a second layer of non-black toner particles, said imaging device records a third latent image at a third exposure level with the third exposure level being a function of the voltage saturation level for said charge retentive surface, the first layer of the non-black toner particles maximum mass and the second layer of the non-black toner particles maximum mass.

18. A printing machine according to claim 17, further including a third developing device which develops the third latent image with a third layer of non-black toner particles.

19. A printing machine according to claim 15, wherein the voltage saturation level for said charge retentive surface is defined as an exposure level at which a voltage on said charge retentive surface is discharged by light exposure to 95 percent of the level for said charge retentive surface.

20. A printing machine according to claim 15, wherein the function for setting the second exposure value is defined as an exposure level greater than or equal to the voltage saturation level for said charge retentive surface divided by a fraction of light transmitted through the first non-black toner layer maximum mass.

21. A printing machine according to claim 20, wherein the function for setting the third exposure value is defined as an exposure level greater than or equal to the saturation level for said charge retentive surface divided by a fraction of light transmitted through the first non-black toner layer maximum mass and the second non-black toner layer maximum mass.

22. A printing machine for creating multiple color images including a charge retentive surface having an exposure response relationship according to:

$$Exp_{pr}(10\%)/Exp_{pr}(50\%)<2.2$$

where:

$Exp_{pr}(10\%)$ represents a first exposure value to which said charge retentive surface is discharged to a percentage difference between the dark decay voltage of said charge retentive surface and the saturation voltage for said charge retentive surface;

$Exp_{pr}(50\%)$ represents a second exposure value to which said charge retentive surface is discharged to a percentage difference between the dark decay voltage of said charge retentive surface and the saturation voltage for said charge retentive surface.

23. A printing machine according to claim 15, further comprising means for pulse width modulating said imaging device.

24. A printing machine wherein said charge retentive surface moves in a process direction according to claim 15, wherein said imaging device forms a spot in a process direction having a minimum size according to:

$$E(X_{ss}/2)/E(0)>0.35$$

where:

$x_{ss}$ represents a spacing between scan lines;

$E(x_{ss})$ represents the imaging device exposure as a function of distance from the center of the spot for a single spot in a slow scan direction; and $E(0)$ represents the imaging device exposure at zero distance from the center of the scan lines.

25. A printing machine according to claim 24, wherein said imaging device forms a spot in a process direction having a maximum size according to $E(x_{ss}/2)/E(0)<0.5$.

26. A printing machine according to claim 24, wherein said imaging device forms a spot in a direction substantially perpendicular to the process direction having a maximum size according to $E(x_{fs}/2)/E(0)$ 0.5 where $E(x_{fs})$ represents the imaging device exposure as a function of distance from the center of the spot for a single spot in a fast scan direction.

27. A printing machine according to claim 15, wherein:

said first developing device develops the first latent image with toner particles of a first color; and said second developing device develops the second latent image with toner particles of a second color with the first color being different from the second color.

28. A printing machine according to claim 27, wherein the first toner particles absorb less light than the second toner particles.

29. A method of creating multiple color images, including:

recording a first latent image on a charge retentive surface having a voltage saturation level;

developing the first latent image with a first layer of non-black toner particles; and recording a second latent image at a second exposure level with the second exposure level being a function of the voltage saturation level for the charge retentive surface and the maximum mass of the first layer of non-black toner particles.

30. A method according to claim 29, further including:

developing the second latent image with a second layer of nonblack toner particles;and recording a third latent image at a third exposure level with the third exposure level being a function of the voltage saturation level for the charge retentive surface and the mass of the first layer of non-black toner particles and the mass of the second layer of non-black toner particles.

31. A method according to claim 30, further including developing the third latent image with a third layer of toner particles.

32. A method of setup for a multicolor printing including:

depositing a first non-black toner layer on a surface;

depositing a second non-black toner layer on the first non-black toner layer; and increasing the second non-black toner layer mass to form a composite color having a saturated hue.

33. A method according to claim 32, further including:

depositing a third non-black toner layer on the first non-black toner layer and the second non-black toner layer; and increasing the third non-black toner layer mass to form a composite color having a saturated hue.

* * * * *